United States Patent [19]

Freitag

[11] 4,388,038

[45] Jun. 14, 1983

[54] AUTOMATIC LOCKING PIN RETRACTION MECHANISM

[75] Inventor: Lonny R. Freitag, Lancaster, Pa.

[73] Assignee: Sperry Corporation, New Holland, Pa.

[21] Appl. No.: 256,455

[22] Filed: Apr. 22, 1981

[51] Int. Cl.[3] ..... E02F 3/16

[52] U.S. Cl. ..... 414/685; 298/17 B

[58] Field of Search ..... 414/685, 694; 172/466; 298/17 B; 292/33, 164, 138, 36, DIG. 49

[56] References Cited

U.S. PATENT DOCUMENTS

| | | | |
|---|---|---|---|
| 1,709,459 | 4/1929 | Callahan | 292/DIG. 49 |
| 2,056,226 | 10/1936 | Mussey et al. | 292/36 X |
| 3,215,292 | 11/1965 | Halls | 414/707 |
| 3,730,362 | 5/1973 | Hurlburt et al. | 414/697 |
| 3,995,761 | 12/1976 | Hurlburt | 414/713 |
| 4,227,852 | 10/1980 | Schmitz et al. | 414/694 |

*Primary Examiner*—Robert J. Spar
*Assistant Examiner*—Donald W. Underwood
*Attorney, Agent, or Firm*—Larry W. Miller; Frank A. Seemar; Darrell F. Marquette

[57] ABSTRACT

An automatic locking pin retraction mechanism for a skid-steer loader is disclosed wherein the locking pins for locking the loader boom arms in an elevated position will be automatically retracted under conditions where the locking pins are extended into the path of movement of the boom arms and the boom arms are below the locking pins and moving upwardly toward engagement with the locking pins, so as to avoid engagement between the boom arms and the locking pins. The retraction mechanism includes a pivotally mounted first member engageable with one of the boom arms and a link interconnecting the first member and a mechanism for simultaneously actuating the locking pins. Pivotal movement of the first member caused by engagement with the boom arm effects a retraction of the locking pins before the boom arms can engage therewith. An over-center spring arrangement is provided to bias the first member in the engagement position or in a neutral position, depending on the position of the first member.

10 Claims, 4 Drawing Figures

AUTOMATIC LOCKING PIN RETRACTION MECHANISM

BACKGROUND OF THE INVENTION

The present invention relates generally to loaders and, more particularly, to an automatic locking pin retraction mechanism for a skid-steer loader to prevent the boom arms from engaging extended locking pins when the boom arms are moving upwardly from beneath the pins.

Locking pins, such as described in U.S. Pat. No. 3,730,362, have been employed on skid-steer loaders to provide a convenient mechanism for locking the boom arms at a predetermined height for a vairety of reasons, including inspection, maintenance and repair of the loader. During normal operation of the loader, the locking pins are retracted out of the generally vertical path of movement of the boom arms. If the operator wishes to lock the boom arms in an elevated position, he would raise the boom structure, extend the locking pins within the path of movement of the boom arms and lower the boom structure until the boom arms are resting upon the locking pins.

When the boom arms are lifted upwardly, particularly when lifting a load, a considerable amount of force is exerted on the boom arms to raise the boom structure. If the locking pins are extended within the path of movement of the boom arms when the boom arms are below the locking pins, engagement between the boom arms and the locking pins can cause substantial damage to either the boom sturcture itself or the locking pin mechamism or, more likely, to both.

Accordingly, it would be desirable to provide a locking pin retraction mechanism that would automatically retract extended locking pins when the boom arms are below the locking pins and moving upwardly toward engagement therewith.

SUMMARY OF THE INVENTION

It is an object of this invention to overcome the aforementioned disadvantages of the prior art by providing an automatic locking pin retraction mechanism for a skid-steer loader.

It is another object of this invention to provide a locking pin retraction mechanism that is operable to automatically retract extended locking pins on a skid-steer loader when the boom arms are below the locking pins and moving upwardly toward engagement with the locking pins.

It is a feature of this invention to eliminate damage to locking pins and/or boom structure when upwardly moving boom arms become engaged with extended locking pins.

It is an advantage of this invention that upwardly moving boom arms cannot engage extended locking pins.

It is another feature of this invention that extension and retraction of the locking pins can be effected through manipulation of the locking pin retraction mechanism.

It is another advantage of this invention that a simple mechanism can be provided for manually operating the locking pin retraction mechanism to selectively extend or retract the locking pins.

It is still another object of this invention to provide an over-center spring to bias the locking pin retraction mechanism toward an engagement position, when the retraction mechanism is in the engagement position, or toward a neutral position, when the retraction mechanism is in a neutral position.

It is a further advantage of this invention that the automatic locking pin retraction mechanism is stabilized in the engagement position until engaged by an upwardly moving boom arm whenever the locking pins are extended.

It is a still further advantage of this invention that the retraction mechanism is stabilized in the neutral position, thereby holding the locking pins in their retracted position, until manually moved into the engagement position.

It is a further object of this invention to provide an automatic locking pin retraction mechanism that is operatively associated with the locking pins such that the locking pins cannot be extended without activating the retraction mechanism.

It is a still further object of this invention to utilize the motion of an upwardly moving boom arm to effect the retraction of an extended locking pin before it can be engaged by the boom arm.

It is yet a further object of this invention to provide an automatic locking pin retraction mechanism for a loader which is durable in construction, inexpensive of manufacture, carefree of maintenance, facile in assemblage, and simple and effective in use.

These and other objects, features and advantages are accomplished according to the instant invention by providing an automatic locking pin retraction mechanism for a skid-steer loader wherein the locking pins for locking the loader boom arms in an elevated position will be automatically retracted under conditions where the locking pins are extended into the path of movement of the boom arms and the boom arms are below the locking pins and moving upwardly toward engagement with the locking pins, so as to avoid engagement between the boom arms and the locking pins. The retraction mechanism includes a pivotally mounted first member engageable with one of the boom arms and a link interconnecting the first member and a mechanism for simultaneously actuating the locking pins. Pivotal movement of the first member caused by engagement with the boom arms effects the retraction of the locking pins before the boom arms can engage therewith. An over-center spring arrangement is provided to bias the first member in the engagement position or in a neutral position, depending on the position of the first member.

BRIEF DESCRIPTION OF THE DRAWINGS

The advantages of this invention will become apparent upon consideration of the following detailed disclosure of the invention, especially when taken in conjunction with the accompanying drawings wherein.

DETAILED DESCRIPTION OF THE PREFERRED EMBODIMENT

Figure 1:
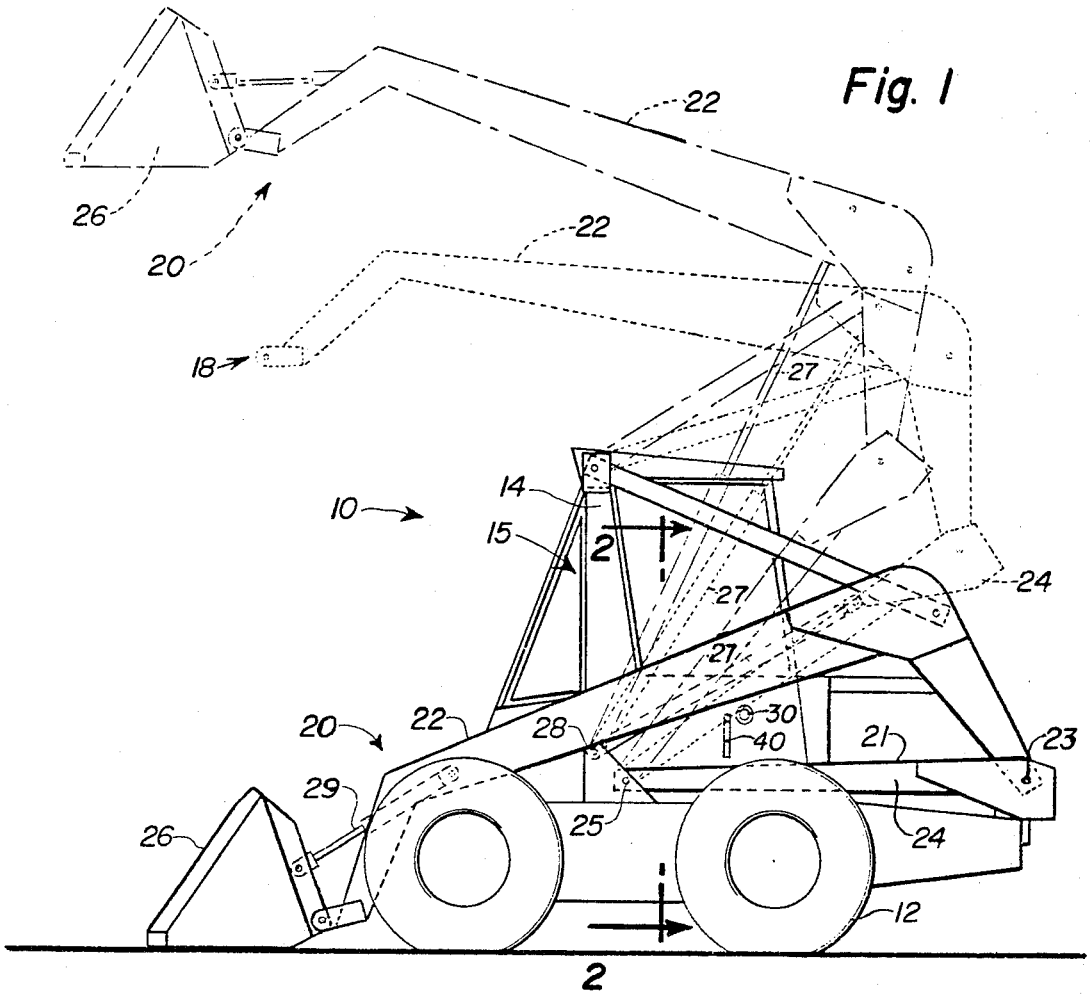
FIG. 1 is a side elevational view of a skid-steer loader incorporating the principals of the instant invention.

Referring now to the drawings and, particularly, to FIG. 1, a side elevational view of a skid-steer loader can be seen. Although the skid-steer loader depicted in FIGS. 1–4 is of the type described for in detail in U.S. Pat. No. 3,215,292, issued to L. M. Halls on Nov. 2, 1965, one skilled in the art should readily realize that the principals of the instant invention are not restricted to this particular type of skid-steer loader.

The loader 10 includes a wheeled frame 12 and spaced apart side members 14 disposed generally vertically and defining an operator's compartment 15 therebetween. The boom structure 20 is basically comprised of a pair of spaced apart upper boom arms 22 pivotally connected at pivots 23 to a pair of corresponding lower boom arms 24. The lower boom arms 24 are, in turn, pivotally connected at pivot 25 to the frame 12. Generally, a working tool, such as the bucket 26, is connected to the upper boom arms 22 forwardly of the loader 10. The boom structure 20 is pivoted about pivot 25 and moved in a generally vertical direction, as shown in phantom in FIG. 1, by a pair of hydraulically actuated lift cylinders 27 interconnecting the frame 12 at the connecting point 28 and the upper boom arms 22. The position of the bucket 26 relative to the upper boom arms 22 can be controlled by manipulation of the hydraulic cylinders 29 interconnecting the bucket 26 and the upper boom arms 22.

Figure 2:
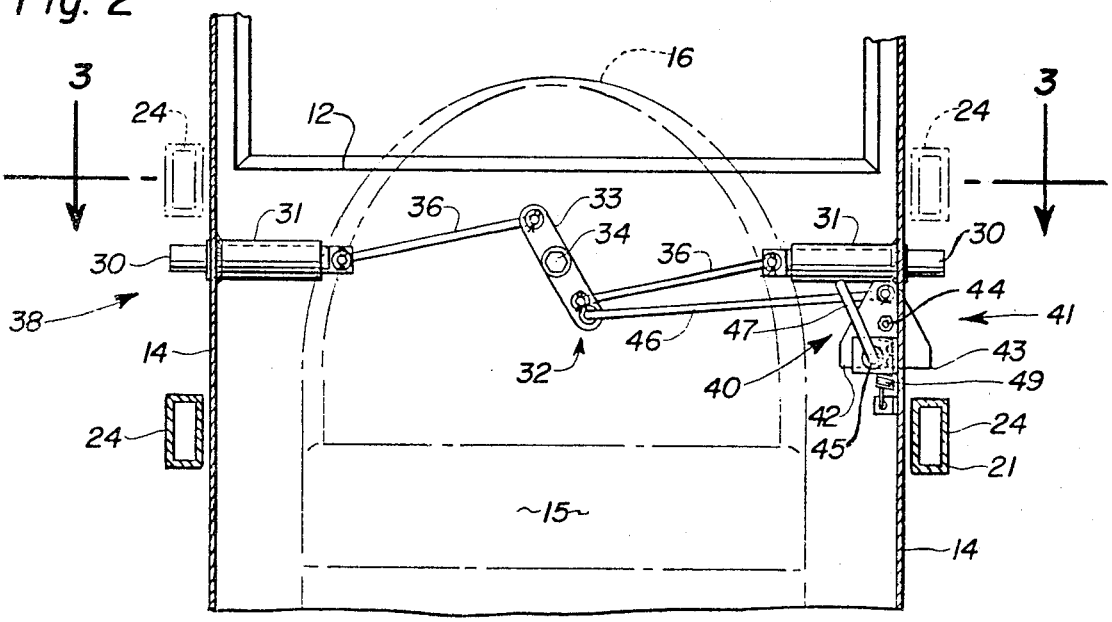
FIG. 2 is a partial cross sectional view of the loader through the operator's compartment taken along lines 2—2 of FIG. 1 with the seat being shown in phantom.
Figure 3:
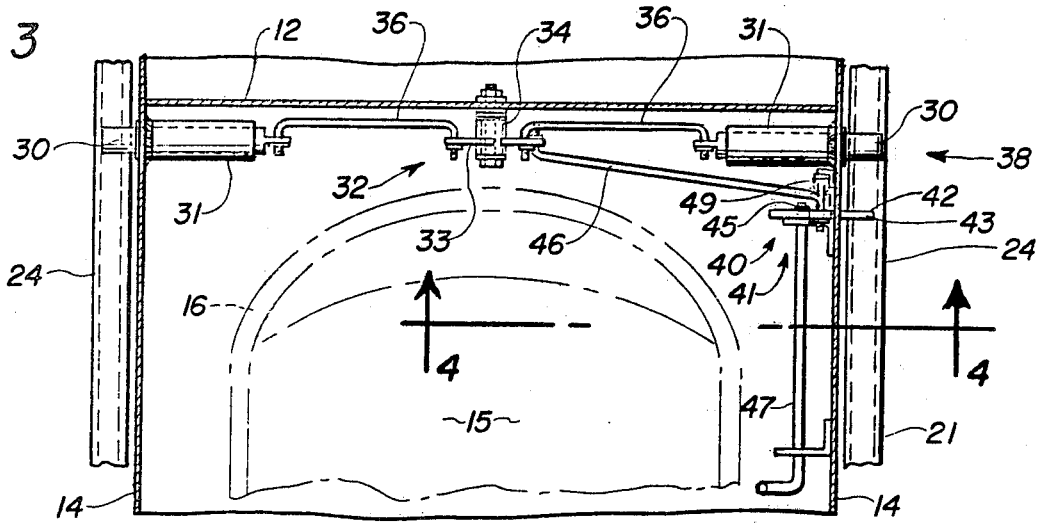
FIG. 3 is a partial cross sectional view of the loader taken along lines 3—3 of FIG. 2 and showing a top view of the instant invention.

Referring particularly to the cross sectional views through the operator's compartment 15 of FIGS. 2 and 3, with the seat 16 being shown in phantom, the structure of the locking pins 30 and retraction mechanism 40 can be seen. The locking pins 30 are slidably received within guide tubes 31 fixed to the side members 14. The locking pins 30 are shown in FIGS. 2 and 3 as being in the extended position 38, wherein they are engageable by the lower boom arms 24 which move in a generally vertical path substantially parallel to the side members 14 and to the path of movement of the upper boom arms 22. The boom structure 20 can be held in an elevated position 18, as seen in phantom in FIG. 1, and prevented from moving lower therefrom by the lower boom arms 24 resting upon extended locking pins 30.

Figure 4:
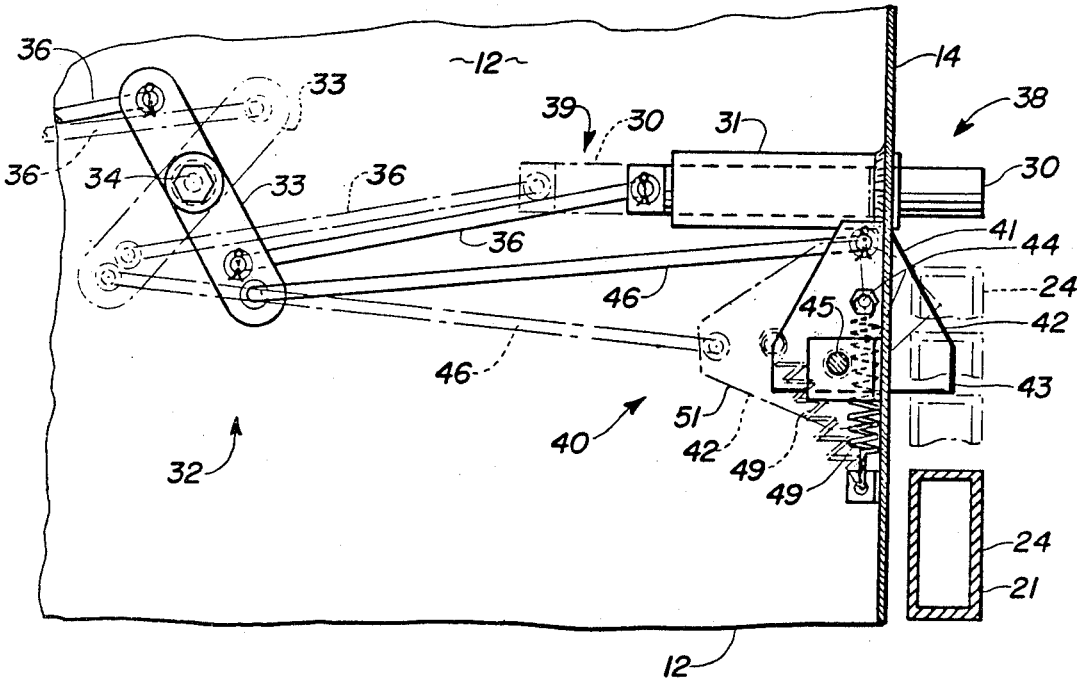
FIG. 4 is a partial cross sectional view of the loader taken along lines 4—4 of FIG. 3 and showing the operation of the instant invention.

The locking pins 30 at either side of the machine are simultaneously moved between the retracted and extended positions by the linkage 32. The extended position 38 is seen in FIGS. 2, 3 and 4, while the retracted position 39 is seen in phantom in FIG. 4. The linkage means 32 for simultaneously actuating the locking pins 30 includes a bell crank 33 pivotally mounted on the frame 12 by the pivot 34 intermediate the ends thereof. Connecting arms 36 interconnect the locking pins 30 and opposing ends of the bell crank 33. By pivotally mounting the bell crank 33 substantially equidistantly between the side members 14 and connecting the connecting arms 36 to the bell crank 33 at substantially equal distances from the pivot 34, a pivotal movement of the bell crank 33 about the pivot 34 will effect a simultaneous and substantially equal movement to the pair of locking pins 30.

The automatic locking pin retraction mechanism 40 includes a first member 42 pivotally mounted on the frame 12 at pivot 45 adjacent the side member 14. The first member 42 is shown in FIGS. 2 and 3 as being in an engagement position 41, wherein a portion 43 of the first member 42 is projected beyond the side member 14 into the path of movement of one of the lower boom arms 21. A rigid connecting link 46 interconnects the first member 42 and the bell crank 33. Any pivotal movement of the first member 42 effects a corresponding pivotal movement of the bell crank 33 via the connecting link 46.

A handle 47 is affixed to the first member 42 at its pivot 45 and projects forwardly into the operator's compartment 15 for convenient access thereto by the operator. A rotative manipulation of the handle 47 would cause a pivotal movement of the first member 42. A spring 49 interconnects the first member 42 and the side member 14 and is positioned in an over-center arrangement which biases the first member 42 toward the engagement position 41 when the first member 42 is in the engagement position 41 as is described in detail below.

The operation of the automatic locking pin retraction mechanism is best seen in FIG. 4. The first member 42 is pivotally moveable between the engagement position 41, as described above, and a neutral position 51 in which the first member 42 is withdrawn entirely from the path of movement of the one lower boom arm 21. Movement of the first member 42 between the engagement position 41 and the neutral position 51 effects a corresponding pivotal movement of the bell crank 33 to extend or retract the locking pins 30. As can be seen in FIG. 4, whenever the locking pin 30 is in its extended position, the first member 42 is in the engagement position 41. If the one lower boom arm 21 should be in a position immediately beneath the locking pins 30 and adjacent to the first member 42 in its neutral position 51, the locking pins are prevented from being moved into the external position 38 because of the utilization of the rigid connecting link 46 and the inability of the first member 42 to move into the engagement position 41.

Accordingly, if the one lower boom arm 21 is below the extended locking pin 30 and is moving upwardly toward engagement therewith, the one lower boom arm 21 will engage the portion 43 of the first member 42 extending within the path of movement thereof. The continued upward motion of the one lower boom arm 21 causes the first member 42 to pivot into its neutral position 51 thereby pivotally moving the bell crank 33 and retracting the locking pin 30. If the lower boom arms 24 are above the extended locking pins 30, the lower boom arms 24 can rest on the extended locking pins 30 to hold it into the elevated position 18, as seen in phantom in FIG. 1.

As can further be seen in FIG. 4, when the first member 42 is in its engagement position 41, the spring 49 imposes a moment about pivot 45, due to the distance between the connection point 44 and the pivot 45, to bias the first member 42 toward engagement position 41. As the first member 42 pivots toward its neutral position 51, the force applied by the upwardly moving lower boom arm 21 to pivot the first member 42 overcomes the force exerted by the spring 49 biasing the first member 42 toward the engagement position 41. After the first member 42 has pivotally rotated to a position where the spring 49 imposes a moment from the opposing side of the pivot 45, the over-center spring 49 biases the first member 42 toward the neutral position 51. In this position, the spring 49 provides a positive means for holding the first member 42 in the neutral position 51 and, therefore, a positive force for stabilizing the locking pins 30 in the retracted position.

Furthermore, the utilization of an over-center spring 49 within the linkage 32 for simultaneously actuating the locking pins 30 provides a positive force for holding the locking pins 30 in either the extended position 38 or the retracted position 39 and stabilizing the linkage 32, independent of the provisions of an automatic locking pin retraction mechanism. A modification of the position of the first member 42 to bring it totally between the side members 14, such that portion 43 would not be projectable within the path of movement of the one lower boom arm 21, the connection of a spring 49 to either the modified first member 42 or the pivoted bell crank 33 in a over-center arrangement would stabilize the linkage 32 and provide a positive force for holding the locking pins 30 in both extended and retracted positions 38, 39, and improve the linkage 32 over the prior art mechanisms without providing a mechanism for automatically retracting the locking pins 30. Accordingly, a sufficient rotative force to overcome the moment exerted by the spring 49 in its over-center position, stabilizing the locking pins 30 in either the extended position 38 or the retracted position 39, would have to be applied to handle 47 in order to manipulate the linkage 32 and extend or retract the locking pins 30.

It will be understood that various changes in the details, material, steps and arrangement of parts which have been described and illustrated to explain the nature of the invention, will occur to and may be made by those skilled in the art upon a reading of this disclosure within the principals and scope of the invention. The foregoing description illustrates preferred embodiments of the invention. However, concepts, as based upon such description, may be employed in other embodiments without departing from the scope of the invention. Accordingly, the following claims are intended to protect the invention broadly as well as in the specific form shown herein.

Having thus described the invention, what is claimed is:

1. In a loader having a mobile frame, including upwardly extending, laterally spaced side members; a boom structure, including a pair of arms pivotally mounted on said frame such that each of said pair of arms is moveable along a generally vertical path adjacent a corresponding side member; power means operatively associated with said boom structure for raising and lowering said arms along said path of movement; a pair of locking pins, each respective said locking pin being mounted on a corresponding said side member adjacent the path of movement of the respective said boom arm, each said locking pin being positionable between a retracted position in which said locking pin is retracted within the respective said corresponding side member out of said path of movement of said boom arm and an extended position in which said pin is projected from said side member into said path of movement to be engageable with the respecitve said boom arm, said boom arms being supportable on said locking pins when said locking pins are in said extended position to prohibit downward movement of said boom arms below said locking pins; and means interconnecting said locking pins for simultaneously actuating the movement of said pins between said retracted position and said extended position, the improvement comprising:

automatic retraction means mounted on said side members below at least one of said locking pins and operatively connected to said means for simultaneously actuating said locking pins for automatically retracting said locking pins under conditions where said locking pins are in said locking position, said boom arms are positioned below said locking pins and said boom arms are moving upwardly toward engagement with said locking pins, said automatic retraction means retracting said locking pins before said boom arms can move upwardly into engagement with said locking pins.

2. The loader of claim 1 wherein said automatic retraction means includes a first member pivotally connected to one of said side members and a connecting link interconnecting said first member and said means for simultaneously actuating said locking pins, said first member being pivotally moveable between an engagement position in which at least a portion of said first member is positioned within said path of movement of the corresponding said boom arm and a neutral position in which said first member is completely out of said path of movement, said connecting link operatively causing said means for simultaneously actuating said locking pins to retract said locking pins before said upwardly moving boom arms can engage therewith when said first member moves from said engagement position to said neutral position.

3. The loader of claim 2 wherein said corresponding boom arm is engageable with said first member to cause said first member to pivotally move from said engagement position to said neutral position and effect the retraction of said locking pins before said boom arms can come into engagement therewith.

4. The loader of claim 3 wherein said automatic retraction means further includes a spring interconnecting said first member and said frame, said first member being pivotally connected to the corresponding said side member in an over-center arrangement, such that said spring is positioned to bias said first member toward said engagement position when said first member is in said engagement position and to bias said first member toward said neutral position when said first member is in said neutral position.

5. The loader of claim 4 wherein said first member further includes a handle affixed thereto and projecting therefrom, said handle being operable upon manual manipulation thereof to pivotally move said first member between said neutral position and said engagement position and effect a corresponding movement of said locking pins between said retracted position and said extended position.

6. The loader of claim 5 wherein said frame supports an operator's compartment positioned between said side members, said first member being a generally planer member, said handle being affixed to said first member at said pivot and projecting substantially perpendicularly to the plane of said first member into said operator's compartment for convenient manual manipulation thereof.

7. The loader of claim 4 wherein said means for simultaneously actuating said locking pins includes a bell crank pivotally mounted on said frame between said side members and having a first end and a remote second end, said bell crank pivot being disposed between said first and second ends, and first and second connecting arms interconnecting said first and second ends, respectively, and said locking pins, each connecting arm being connected, respectively, to one of said locking pins, said connecting link interconnecting said first end of said bell crank and said first member such that pivotal movement of said first member effects a corresponding pivotal movement of said bell crank through said connecting link which, in turn, effects a movement of said locking pins between said retracted position and said extended position through said connecting arms.

8. The loader of claim 7 wherein said locking pins are slidably moveable between said retracted positions and said extended position along a substantially linear path.

9. The loader of claim 8 wherein said bell crank pivot is disposed substantially equidistantly between said side members, said first and second connecting arms being connected to said first and second ends at points substantially equidistant from said bell crank pivot so that the movement of each said locking pin generally corresponds equally to the other said locking pin.

10. The loader of claim 9 wherein said power means includes a pair of hydraulically operated lift cylinders.

* * * * *